United States Patent [19]

Skipper et al.

[11] Patent Number: 4,749,044

[45] Date of Patent: Jun. 7, 1988

[54] APPARATUS FOR WASHOVER FEATURING CONTROLLABLE CIRCULATING VALVE

[75] Inventors: Uvon Skipper, Bellaire; E. E. Herod; Mack M. Ponder, both of Alice, all of Tex.

[73] Assignee: J. B. Deilling Co., Houston, Tex.

[21] Appl. No.: 10,209

[22] Filed: Feb. 3, 1987

[51] Int. Cl.[4] ..... E21B 31/03; E21B 34/10

[52] U.S. Cl. ..... 166/323; 166/301; 166/312; 166/332

[58] Field of Search ..... 166/301, 312, 323, 332, 166/374, 377, 378

[56] References Cited

U.S. PATENT DOCUMENTS

| | | | |
|---|---|---|---|
| 2,762,438 | 9/1956 | Naylor | 166/301 |
| 3,236,307 | 2/1966 | Brown | 166/312 |
| 3,765,487 | 10/1973 | McEver | 166/301 |
| 3,807,428 | 4/1974 | Watkins et al. | 166/323 |
| 4,062,406 | 12/1977 | Akkerman et al. | 166/323 |
| 4,162,691 | 7/1979 | Perkins | 166/312 |
| 4,434,854 | 3/1984 | Vann et al. | 166/323 |

*Primary Examiner*—Stephen J. Novosad
*Assistant Examiner*—Terry Lee Melius
*Attorney, Agent, or Firm*—Gunn, Lee & Jackson

[57] ABSTRACT

In a drill string connected to a wash pipe for retrieval of a fish in a well borehole, an apparatus comprising a connected tubular member therebetween having an internal movable sleeve. The sleeve is located close over a set of bypass ports to the exterior. The ports are selectively opened or closed; when closed, the fluid flow is directed to the fish in the wash pipe. A method of washing is set forth including the steps of controlling fluid flow so that, during running in of the wash pipe over the fish, fluid is bypassed. The bypassing occurs during the fish engagement improving speed of running in up to the time the wash pipe telescopes significantly over the fish.

15 Claims, 3 Drawing Sheets

APPARATUS FOR WASHOVER FEATURING CONTROLLABLE CIRCULATING VALVE

BACKGROUND OF THE DISCLOSURE

In drilling a well, the drill string is connected with the drill bit as the hole is deepened. Occasionally, the hole will deviate and form what is known as a key seat which tends to stick the pipe. At other times, there will be a failure of the drill string where the pipe is broken with part of the drill string retrieved, part of the drill string in the hole. In other instances, differential pressure sticking will grab and hold the drill string, often relieved by removing part of the drill string and leaving the lower end of the drill string in the hole. In a variety of circumstances exemplified by those listed above, it is sometimes necessary to remove the drill string, leaving a part of the drill string in the hole and thereafter conduct a washover operation. In doing this, a larger diameter pipe is lowered into the borehole and is stabbed over the remaining portion of the drill string which was left in the borehole. This portion is commonly known as a fish, and one procedure for removing the fish is a washover process. In washover, the drill string is removed and repositioned in the borehole with a large diameter pipe at the lower end. The wash pipe diameter is sufficient to telescope over the stuck fish. A large flow of drilling fluid is then introduced through the drill string and the wash pipe while rotating with weight on the drill string. The wash pipe is advanced to telescope over the fish. This washover will typically release the stuck fish and thereby free it so that the fish can then be retrieved from the borehole.

A successful washover job requires a large flow of fluid. The drilling fluid flow is almost unimpeded when the washover pipe is clear of obstructions. By contrast, the drilling fluid flow is impeded when going in the hole, if the wash pipe OD has little clearance in the well borehole, or if the OD of the fish has little clearance from the ID of the wash pipe when it is engaged. Both of these conditions tend to divert the flow of fluid up the drill string. This action will cause the drill pipe to overflow at the surface, and also will retard lowering the string into the well borehole because of the piston action created by the restricted fluid flow.

Successful washover operations do require a substantial flow delivered to the right portion of the borehole to complete a washover job. Consider as an example a 500′ fish which is stuck in a key seat. Assume that the key seat is approximately half the length of the fish. The washover pipe is run into the well to extend over the stuck fish. Assume in this example that the drill bit forms a hole which is approximately 7 inches in diameter while the drill pipe of the fish is typically 4 ½ or 5 inches OD. This leaves little clearance for the wash pipe to pass over the stuck fish. When the wash pipe telescopes over the drill pipe in the borehole, the stuck fish tends to plug the wash pipe thus forcing the fluid up the drill sting causing the drill string to over flow at the surface, impeding the process of lowering the string in the hole.

This apparatus is installed in a drill string at the top end of the wash pipe. It vents drilling fluid while the wash pipe is being stabbed into the borehole while it telescopes over the stuck fish. When the wash pipe is partially obstructed by the stuck fish partly in the bottom end of the wash pipe, the wash pipe is pushed onto the fish until such obstruction forces drilling mud in the well up the drill string. perhaps to spill on the rig floor. The present apparatus responds to this increase in pressure and bypasses drilling mud through ports isolated by a movable sleeve. The bypass route opens into the annular space above the wash pipe. The wash pipe may pass over the stuck fish without overflowing at the top end of the drill string. When the pump is turned on the sleeve is moved to close the ports and the flow from the pump is then directed to the bottom end of the wash pipe. This delivers the washover fluid at the location where it is most needed. This enables a more rapid retrieval of the fish in that the washover procedure is expedited; also, the rig floor is kept clean.

The method and apparatus of the present disclosure are thus summarized as providing a wash pipe for attachment to the lower end of a drill string to be run into a borehole to undertake a washover operation. The washover pipe is connected with the drill string thereabove by means of a tubular member which provides diametric transition as necessary between the larger wash pipe and the smaller drill string thereabove. On the interior, there is a lengthwise sleeve. In the up position, it aligns ports through the sleeve with ports in the outer wall. This serves as a bypass for drilling fluid forced upward through the drill string, thereby reducing the washover fluid flowing through the drill string to the surface. The sleeve is forced upwardly by means of a coil spring or collet spring. A restricted orifice at the top end of the sleeve makes it responsive to an increase in pump pressure. Where there is an increase in supply pressure and hence pressure drop across the restriction, the restriction and connected sleeve is then forced downwardly. There is also an unbalanced piston (pressure down) to help force the sleeve over the ports should the flow be restricted sufficiently to cause the restriction not to activate. When it moves downwardly, it closes off the ports in the sleeve, achieving an isolation by suitable seals and thereby preventing use of the bypass route for the washover fluid. The device preferably includes a latch mechanism which secures it in the down or closed position of the sleeve. An alternate embodiment is also disclosed.

A procedure contemplating washover assistance of fish retrieval is set forth. All of this will be detailed in greater detail on review of the present disclosure.

DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

and

Figure 6:
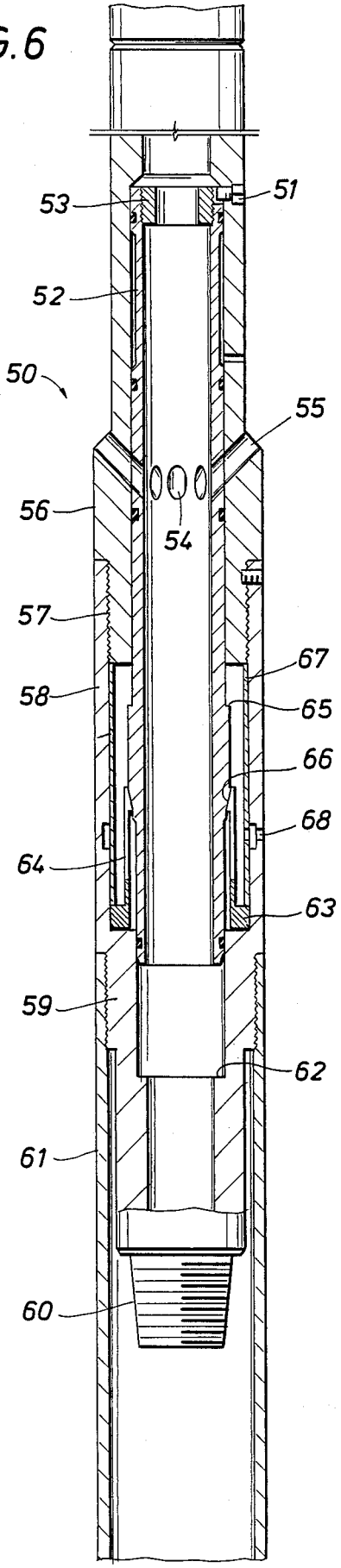
FIG. 6 is a sectional view similar to FIG. 2 through an alternate embodiment again showing a sleeve with ports therein relative to communicating ports to define washover fluid bypass.
Figure 7:
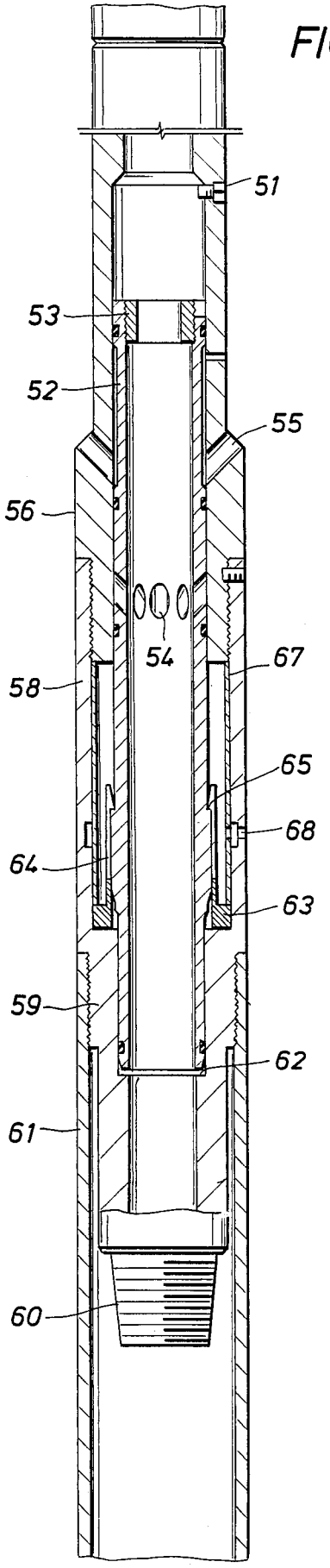

FIG. 7 is a view of the same structure shown in FIG. 6 wherein the sleeve has moved downwardly in response to pressure differential to close off the bypass route for washover fluid.

DETAILED DESCRIPTION OF THE PREFERRED EMBODIMENT

Figure 1:
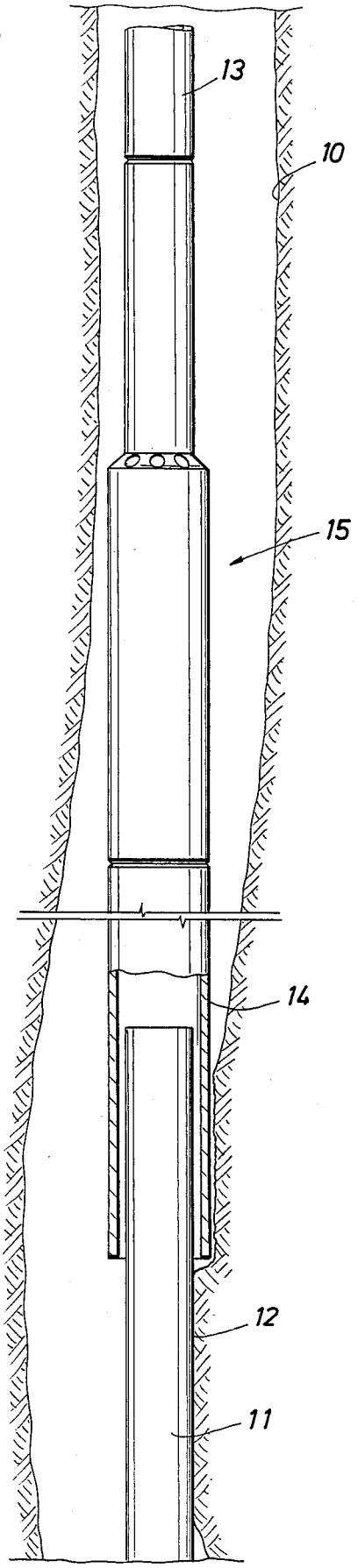
FIG. 1 shows a washover pipe on a drill string for retrieving a fish in a borehole, the present apparatus being connected between the washover pipe and the drill string.
Figure 3:
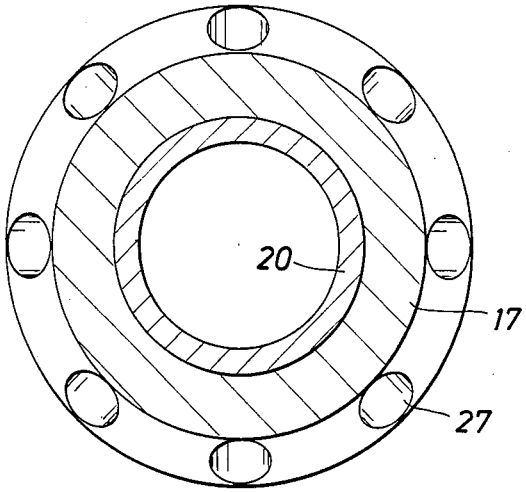
FIG. 3 is a sectional view taken along the line 3—3 of FIG. 2 showing details of construction of bypass ports for bypassing washover fluid.

Attention is first directed to FIG. 1 of the drawings where a washover procedure will be first described. Thereafter, the washover circulating valve of this disclosure will be incorporated with the structure shown in FIG. 1.

Assume in FIG. 1 that an open hole has been drilled to a specified depth. The hole is identified by the numeral 10. A fish 11 is stuck in the borehole. The fish 11 can be long or short. It can be made by unthreading the upper portion of the drill string, thereby leaving a open box connection at the top end of the fish. Alternatively, it can be formed by twisting off the pipe, typically a situation in which significant damage may occur. Whatever the cause, the fish 11 is of substantial length and includes the stuck portion of pipe and drill bit, some drill collars and drill pipe. The length of the pipe can be varied over a wide range. The pipe is stuck by means of a key seat, one such key seat being exemplified at 12. It can be stuck for other reasons also.

In a retrieval procedure, a portion of the drill string is retrieved. It is run back into the borehole 10. The upper portion of the drill string is identified by the numeral 13. It connects at the bottom with a wash pipe 14. The wash pipe 14 is larger diameter. It is sized so that it will telescope over the stuck fish. The washover pipe 14 is joined to the drill string by means of the circulating valve assembly 15 of this disclosure.

The present apparatus thus connects between the drill string and the wash pipe to provide two fluid flow paths. One fluid flow path is through a set of bypass passages to the larger annular area above the wash pipe. It will be observed in FIG. 1 that the wash pipe 14 telescopes over the stuck fish as a means of retrieving and freeing the fish.

Figure 2:
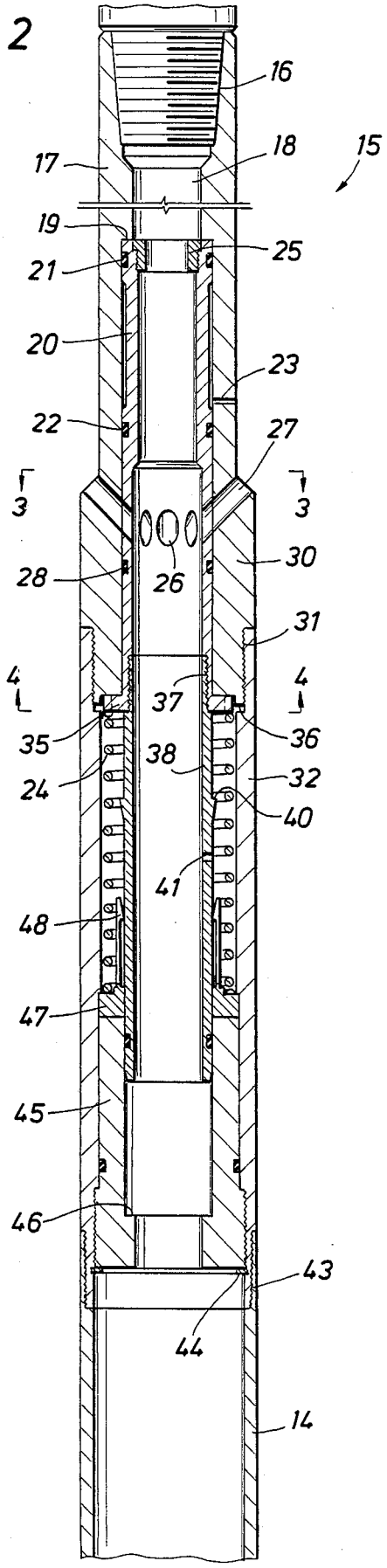
FIG. 2 is an elongate sectional view through the washover circulating valve of the present disclosure further including details of construction of the drill string thereabove and wash pipe therebelow.

Attention is next directed to FIG. 2 of the drawings which shows the apparatus of the present disclosure. At the upper end, it is provided with a conventional threaded box 16 which is formed in accordance with conventional industry standards. The box threads are formed in the outer tubular member 17. Typically, the tubular member 17 is substantial length and extends downwardly with a central axial passage 18. The passage 18 has an internal shoulder 19 which faces downwardly. The shoulder 19 abuts the upper end of a movable sleeve 20. The sleeve 20 telescopes on the interior of the tubular member 17. The sleeve 20 is equipped with a seal member 21 at the upper end. A similar seal member 22 is spaced therefrom, the seal members defining a region where fluid communication on the exterior is forbidden. A pressure relief hole 23 is drilled through the tubular sleeve to introduce fluid flow to the interior of the tubular member 17 for pressure equalization purposes.

The device is pressure responsive. This is accomplished by positioning a restrictive orifice or ring 25 at the top end of the sleeve. It fits adjacent the shoulder 19 which limits upward travel of the sleeve 20. Moreover, the restrictive orifice is sized so that in conjunction with the cross sectional area of the passage 18 and the obstruction placed in the wash pipe as will be described, restriction creates an increase in pressure drop. This increase in pressure drop creates an increased pressure forcing the sleeve 20 downwardly. To aid in closing there is an unbalanced piston (pressure down) so the ports will close even if the flow restriction below negates the action of the restrictive orifice. The sleeve is normally held in an up position by means of a compressed spring coil 24. The spring 24 bears against the sleeve. The spring 24 shown in the elongated condition in FIG. 2 while it is compressed in FIG. 5. Operation of the device will be set forth to explain how this operates. As shown in FIG. 2, the sleeve 20 is equipped with a set of internal ports or passages 26. The ports are drilled through the sleeve to provide an alternate fluid flow path. There are several ports. They are aligned with a set of matching passages or ports 27 which are formed through the tubular member 17. When aligned, the several ports collectively provide an aggregate cross sectional area flow path which is sufficient to deliver all the fluid flow to the exterior of the wash pipe in the event the axial flow path is completely closed. In the position of the sleeve in FIG. 2, the ports are aligned. This up position enables fluid to bypass through the bypass route as will be explained when operation is described. The bypass route is assured by aligning the ports 26 with the ports 27. Thus, vertical alignment is achieved by locating the two sets of ports such that the sleeve is at its upper extremity of movement abutted against the shoulder 19. Rotational alignment is also accomplished by a means to be described to assure that the individual ports line up also to enable a substantial fluid flow path to be provided. The several ports are protected against leakage to the exterior of the sleeve by means of the seal member 22 previously defined and a cooperative seal ring 28. The seals 22 and 28 fully surround the tubular member 20 and isolate against leakage to the exterior of the sleeve.

Proceeding on downwardly with this structure as shown in FIG. 2, the ports 27 open at an external shoulder where the tubular member 17 is larger. This larger portion is indicated generally by the numeral 30. The larger diameter portion 30 is cooperative with an extension sleeve 32 which is joined at a set of threads 31. The threaded connection permits the extension sleeve to be taken apart for servicing of the components on the interior of the apparatus 15. The sleeve 20 terminates at an outwardly directed set of spline teeth 35. The teeth align with cooperative teeth at 36. This is perhaps better shown in the sectional view of FIG. 4 where the spline teeth 35 are illustrated. They mesh with and telescope into the cooperative spline teeth 36.

Figure 4:
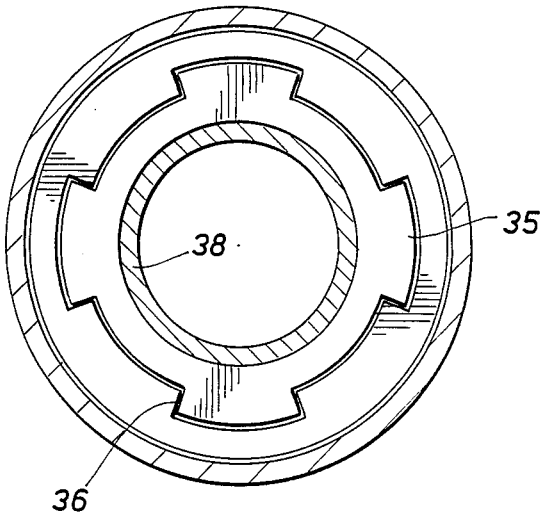
FIG. 4 is a sectional view through the present apparatus showing a spline arrangement to align ports in a movable sleeve with ports in the surrounding sleeve.

The sleeve 20 is made in multiple components, there being a threaded connection at 37 with a continuation sleeve 38, and this is also shown in FIG. 4. The sleeve 38 is surrounded with the coil spring 24 which bears against the spline teeth 35 attached to the sleeve. Moreover, the sleeve 38 which serves as an extension has an enlargement 40 which comprises an upwardly facing shoulder. This is formed on the exterior as used in a latching mechanism. The sleeve 38 has a passage formed therein at 41, the passage serving as a pressure equalization pathway to prevent pressure build up on the interior of the tool but on the exterior of the telescoping sleeve. The outer sleeve 32 extends downwardly to a threaded connection at 43 and joins with another tubular member which is the washover pipe 14. This can be quite long. It can be formed in one or more sections as required. At the threaded connection between the two, an internal lock ring 44 is captured. The lock ring 44 holds in position a bottom sub 45. The sub 45 fits around the telescoping sleeve 20 and the extension sleeve 38. It has an axial passage which permits downward movement of the sleeve on the interior at least until the movement is limited by an upwardly facing internal shoulder 46. The shoulder 46 limits the travel of the telescoping sleeve for reasons to be described. The sub 45 is captured in position. It is on the interior of the structure with an upwardly facing shoulder which receives a thrust ring 47. The thrust ring has a elongate upwardly extending sleeve portion which is shaped into a set of collet fingers 48. The collet fingers are thus split lengthwise to define individual fingers, and they all are equipped with latching undercut shoulders which engage the shoulder 40. In the contrast found between FIGS. 2 and 5, the collet fingers are latched to hold the sleeve downwardly. The collet fingers are smaller in diameter and fit within the coil spring 24. They are sized so that the coil spring can be compressed around them. Moveover, the several collet fingers are used to hook or latch onto the sleeve to hold it in the down position. The enlargement 48 thus has a tapered shoulder encouraging the collet fingers to ride gently over and reach into a latching position.

Figure 5:
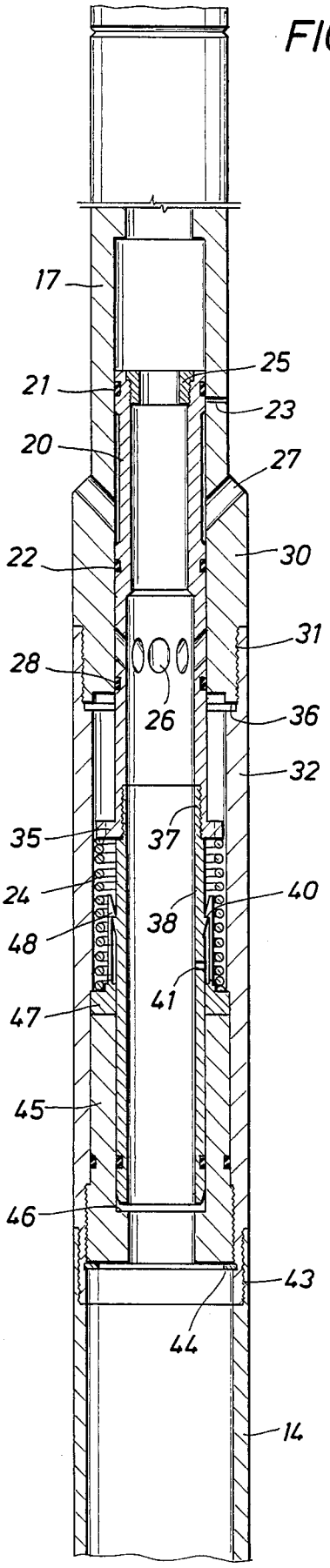
FIG. 5 is a view similar to the view of FIG. 2 showing a restricted orifice connected with the sleeve wherein the sleeve and orifice have moved downwardly in response to pressure differential to change the bypass flow route for washover fluid.

Operation of the telescoping sleeve shown in FIG. 2 should be explained. As long as the pressure drop caused by the restriction 25 is nominal, the sleeve is held upwardly in the illustrated position of FIG. 2. It is retained in this position by the coil spring 24 which creates a force overcoming the downward force acting at the restriction 25. When the pump pressure is increased, and the pressure drop across the restriction 25 increases, the sleeve 20 is forced downwardly by the force created by the flow. Even if fluid flow is nil as a result of a downhole obstruction, the sleeve will close because it is an unbalanced piston. The upper end of the sleeve has a larger surface area than the lower end of the sleeve. Therefore, if flow is too low to operate the restrictive orifice by creating a downward force, the sleeve is forced downwardly by pressure acting on the uneven end areas. Downward travel is limited by the shoulder 46. Downward movement of the sleeve 20 is thus normally initiated by pressure differential acting at the restriction 25 at the upper end of the sleeve. Another force driving the sleeve downwardly is obtained from pressure acting on the unbalanced piston which results from an area differential. Before it moves, the bypass arrangement through the ports 26 and the passages 27 is open, thereby deflecting mud flow to the exterior. On sufficient pressure differential across the restriction 25, the sleeve 20 is forced downwardly. As noted, it travels downwardly until limited by the shoulder 46. As it moves downwardly, the several collet fingers 48 deflect outwardly and latch over the shoulder 40. This is accomplished while compressing the spring 24. FIG. 5 shows the collet fingers latched and holding the sleeve in the downward position. This lock arrangement serves to hold the sleeve in the down position of FIG. 5. The bypass route is closed and sealed by the seal ring 22 which is now interposed between the ports 26 and the passages 27. In this arrangement, no additional fluid can flow out through the bypass. This assures that the fluid is fully transferred along the drill string and directs total flow around the rotary shoe which is typically attached at the bottom of the wash pipe. This delivers the mud flow out through the wash pipe and rotary shoe for conducting a wash operation. At this point, drill string manipulations can then be undertaken to force the wash pipe further into the borehole, washing at the rotary shoe on discharge of the mud flow to free the fish, and ultimately accomplish unsticking of the fish.

An alternate embodiment is illustrated in FIGS. 6 and 7. This device is indicated generally by the numeral 50. In the apparatus, it again has a telescoping sleeve 52 with a restriction 53 at the upper end. Several lugs 51 aligned with slots at the upper end of the sleeve 52 prevent rotation to assure port alignment. The sleeve is penetrated by several ports 54 which open to the exterior. The several ports align with passages 55 which complete the bypass route. Moreover, the exterior of the structure is enlarged at 56 to define a thicker portion, enabling a threaded connection at 57 with a sleeve extension member 58. The sleeve 58 extends downwardly to a sub 59 which terminates at a conventional threaded pin 60. The pin 60 is selected to match the exposed box on the top end of the stuck fish to implement retrieval. The sub 59 has a threaded exterior which permits connection with a wash pipe 61. The wash pipe extends further and is sized in diameter and length to fit ovver the fish. The wash pipe 61 telescopes over the stuck fish. As the wash pipe is advanced and washing continues to remove the material which sticks the fish, by means of rotation, washing and advancing the wash pipe can fully telescope over the fish until the threaded pin engages the upper end of the stuck fish. When advancement stops, the wash pipe is then rotated by rotating the drill string from the surface, thereby threading the pin 60 to the exposed upper end of the fish. Since the pin 60 matches in size and thread configuration with the box of the exposed fish at the upper end the two can be threaded to have quick retrieval.

Important details of construction on the interior of the means 50 should be noted. The sub 59 has an internal shoulder 62 which limits the lower end of travel of the sleeve 52. A ring 63 positioned on the interior of the apparatus 50 supports a set of collet fingers 64. The collet fingers extend upwardly parallel to the sleeve 52. The sleeve 52 has an external shoulder 65 which, in the up position of FIG. 6, is remote from the collet fingers 64. The exterior surface is slightly enlarged, having a tapered face 66 which abuts the collet fingers in the position of FIG. 6. This tapered area enables the collet fingers to deflect, thereby enabling the collet fingers to ride along the exterior of the sleeve 52 until sufficient travel has occurred (compare FIG. 7 with FIG. 6) at which point latching occurs. The collet fingers have sufficient spring force to clamp the telescoping sleeve in place until pump pressure is applied. The region around the collet fingers is isolated by an internal sleeve 67 which is sized to fit in that area, and is suitable pressure relief hole 68 opens into the sleeve. This permits pressure equalization so that the sleeve is not operating against a pressure build-up on downward movement.

The apparatus shown in FIGS. 6 and 7 functions in the same manner as does the embodiment 15 previously described. The primary difference however is the ability to thread the pin 60 into the stuck fish. During a washover operation, this is advantageous presuming the fish is known to have an exposed box, and the thread configuration and size of the box are known. In instances where this information is verified, the embodiment 50 can then be used to retrieve the stuck fish. Of course, the wash pipe below the pin 60 telescopes over the fish.

Perhaps an important factor to add in describing the operation of a washover fish retrieval utilizing the present apparatus is that the incorporation of this apparatus between the drill pipe and the wash pipe enables improved speed in a close tolerance situation. As will be understood, when the fish enters the wash pipe, plugging the wash pipe causes drilling fluid to fill the drill string to slow fluid flow. This fluid back flow along the drill string (being lowered into the borehole), interferes with rig floor procedures. The present invention thus provides an apparatus and method whereby fluid is normally transferred by the mud pumps at the surface into the drill sting and wash pipe as the wash pipe is telescoped over the fish. Moreover, the flow restriction is responsive to pump pressure close the valve of this apparatus, thereby directing fluid flow down through the wash pipe. During wash pipe insertion with no mud pumping, the valve is left open to prevent upward mud flow to the well head along the drill string; the mud level is equalized between the drill string and annular space by flow through the bypass.

While the foregoing is directed to the preferred embodiment, the scope is determined by the claims which follow.

What is claimed is:

1. For use with a wash pipe, apparatus which comprises:

(a) an elongate hollow tubular member;

(b) means at the upper end of said tubular member connectable to a drill string for running into a well borehole;

(c) means at the lower end of said tubular member connectable to a wash pipe for running into a well borehole;

(d) a movable sleeve in said tubular member mounted for movement between first and second positions;

(e) port means formed in said sleeve;

(f) bypass port means in said tubular member defining a drilling fluid flow path through said tubular member to the exterior of said tubular member;

(g) seal means cooperative with said tubular member and said port means to prevent fluid flow through said bypass port means when said sleeve is in the second position while permitting fluid flow when said sleeve is in the first position; and (h) fluid flow restrictor means for moving said sleeve, said restrictor means responding to a velocity related pressure drop during fluid flow.

2. The apparatus of claim 1 including resilient means forcing said sleeve toward the first position.

3. The apparatus of claim 1 including a drilling fluid flow path along the length of said tubular member and including a flow restrictor sized to create a force moving said sleeve along said tubular member.

4. The apparatus of claim 1 wherein the means at the upper end of said tubular member includes a threaded box connection.

5. The apparatus of claim 4 wherein the means at the lower end of said tubular member includes a threaded pin connection for the wash pipe.

6. The apparatus of claim 5 including a second threaded pin connection sized to fit in the wash pipe and adapted to thread to an exposed box connection of a fish in the well borehole.

7. The apparatus of claim 1 including a force creating restrictor at the top of said sleeve to create a force moving said sleeve, said sleeve movable between upper and lower abutting shoulders in said tubular member spaced to limit travel of said sleeve.

8. The apparatus of claim 7 wherein said shoulders are above and below said bypass port means and enable said sleeve to move axially of said tubular member between the first and positions, and wherein said first position aligns said port means with said bypass port means to direct fluid flow to the exterior of said tubular member.

9. The apparatus of claim 8 including a second seal means and wherein said first and second seal means are external seal rings about said sleeve and are located above and below said port means to prevent flow leakage when said sleeve is in the first position.

10. The apparatus of claim 9 wherein said seal rings are spaced along said sleeve to move to a blocking position on axial movement of said sleeve along said tubular member.

11. The apparatus of claim 1 including means for latching said sleeve on movement in said tubular member to the second position.

12. The apparatus of claim 11 wherein said latching means comprises a set of deflectable collet fingers reaching over and latching a mating surface on said sleeve.

13. The apparatus of claim 12 wherein said sleeve includes an exposed shoulder comprising said mating surface.

14. The apparatus of claim 13 wherein said collet fingers ride along the outer surface of said sleeve to latch and hold against the urging of a coil spring forcing said sleeve to the first position.

15. The apparatus of claim 1 wherein said sleeve is an unbalanced area piston having a larger upper end to force said sleeve downwardly.

* * * * *